US007393252B2

(12) United States Patent
Ribeau et al.

(10) Patent No.: US 7,393,252 B2
(45) Date of Patent: Jul. 1, 2008

(54) FEMALE ELECTRICAL CONTACT ELEMENT AND METHOD FOR MAKING A FEMALE ELECTRICAL CONTACT ELEMENT

(75) Inventors: Pascal Ribeau, Le Mans (FR); Jean-Michel Dechanteloup, Le Mans (FR)

(73) Assignee: Sourian, Versailles (FR)

( * ) Notice: Subject to any disclaimer, the term of this patent is extended or adjusted under 35 U.S.C. 154(b) by 0 days.

(21) Appl. No.: 11/492,743

(22) Filed: Jul. 25, 2006

(65) Prior Publication Data

US 2007/0037457 A1 Feb. 15, 2007

(30) Foreign Application Priority Data

Aug. 4, 2005 (FR) ..... 05 52433

(51) Int. Cl.
*H01R 13/02* (2006.01)

(52) U.S. Cl. ..... 439/891; 439/852; 439/843

(58) Field of Classification Search ..... 439/891, 439/879, 843, 851, 852
See application file for complete search history.

(56) References Cited

U.S. PATENT DOCUMENTS

| | | | | |
|---|---|---|---|---|
| 2,716,737 | A * | 8/1955 | Maberry | 439/176 |
| 3,210,720 | A * | 10/1965 | Harris, Jr | 439/518 |
| 3,300,752 | A | 1/1967 | Benoit et al. | |
| 3,564,487 | A * | 2/1971 | Upstone et al . | 439/843 |
| 3,748,632 | A * | 7/1973 | Tanges, Jr. | 439/686 |
| 4,170,383 | A * | 10/1979 | Mocek et al. | 439/601 |
| 4,702,707 | A * | 10/1987 | Hillbish | 439/80 |
| 4,752,253 | A | 6/1988 | Neumann et al. | |
| 5,106,328 | A * | 4/1992 | Prochaska et al. | 439/751 |
| 5,449,304 | A | 9/1995 | Huss, Jr. et al. | |
| 5,601,457 | A | 2/1997 | Le Gall | |
| 5,676,571 | A | 10/1997 | Matthews | |
| 5,797,760 | A * | 8/1998 | Swindlehurst | 439/289 |
| 6,102,751 | A | 8/2000 | Becker | |
| 6,250,974 | B1 | 6/2001 | Kerek | |
| 6,358,071 | B1 | 3/2002 | Moga | |
| 6,520,998 | B1 | 2/2003 | Scholler et al. | |
| 2003/0077950 | A1 | 4/2003 | Swearingen et al. | |
| 2003/0207607 | A1 | 11/2003 | Matsumoto | |
| 2004/0180563 | A1 | 9/2004 | Coughlan | |

FOREIGN PATENT DOCUMENTS

| | | | |
|---|---|---|---|
| DE | 317343 | | 6/1917 |
| DE | 3608276 | A1 | 9/1987 |
| DE | 198 36 196 | A1 | 2/1999 |
| DE | 19941515 | A1 | 3/2001 |
| DE | 10138975 | A1 | 2/2002 |
| EP | 0283768 | A2 | 9/1988 |
| FR | 1430294 | A | 3/1966 |
| FR | 2 865 319 | A1 | 7/2005 |
| GB | 620541 | A | 3/1949 |
| GB | 2 225 180 | A | 9/1989 |

* cited by examiner

*Primary Examiner*—Hien D. Vu
(74) *Attorney, Agent, or Firm*—Patterson, Thuente, Skaar & Christensen, P.A.

(57) ABSTRACT

The female contact element comprising a rear shank designed to receive an electrical conductor and a front shank equipped with an elastic socket designed to receive a male contact element. The female contact element is formed from a one-piece tubular body in which the front shank and the rear shank are arranged, the elastic socket being fixed mounted in the front shank. A method for manufacturing such a female contact element.

8 Claims, 1 Drawing Sheet

FEMALE ELECTRICAL CONTACT ELEMENT AND METHOD FOR MAKING A FEMALE ELECTRICAL CONTACT ELEMENT

RELATED APPLICATION

This application claims priority to French Application No. FR 05 52433 filed Aug. 4, 2005.

TECHNICAL FIELD

The invention relates to a female electrical contact element able to convey a high current flow. The invention also relates to a method of making such a female electrical contact element. The invention finds applications particularly in the field of electrical connectors designed to be utilized under severe conditions, for example in the field of avionics where temperature and vibration conditions may be extreme.

BACKGROUND ART

A female electrical contact element comprising an elastic holding element that is able to maintain in position a male electrical contact element in a generally cylindrical form is already known.

In particular, a female contact element in three parts is known from document FR 2 692 080, such as represented in FIG. 1 of the prior art. A first part is comprised of a rear shank 2 designed to receive an electrical conductor such as a cable. The rear shank 2 is made of a material allowing said shank 2 to be crimped onto the electrical conductor. A second part 3, or active part, is made of a material having high elasticity as well as good electrical conductibility. The active part 3 is designed to receive a male contact element, or terminal, in a generally cylindrical form. The active part 3 is, for example, formed from a socket divided up into longitudinal slots 4 in order to arrange a plurality of longitudinal tongues 5. The tongues 5 are made in such a way as to present, at the location of a free end designed to receive the male terminal, an inner swelling. Said inner swelling is designed to be in contact with the male terminal when said terminal is inserted in the active part 3 of the female terminal 1. Around the front part 3 is mounted a tube 6 joined on the common base 7 of the tongues 5. The tube 6 supports the tongues 5 when they are deformed by the introduction of the male terminal into the active part 3. When the male terminal penetrates between the tongues 5 of the active part 3 of the female terminal 1, the deformation of the tongues 5 is such that the part lacking swelling of said tongues 5 takes the general form of an S, while the part with swellings remains straight with relation to the tube 6. Each tongue 5 therefore is supported by the male terminal on the entire surface of its swelling, which allows good electrical conduction between the female terminal and the male terminal and maintenance of the male terminal in the active part 3 of the female terminal 1 to be ensured, even in the case of significant vibrations.

However, such a female terminal is difficult to make inasmuch as the terminal is formed of three independent parts that are integral with each other. Therefore, it is necessary to develop each of the three parts of the female terminal very precisely in such a way as to guarantee a good connection between each of the pieces. Particularly, it is important to make the tube 6 with a very high precision, which must be joined on the active part 3, since contact between the active part 3 and the tube 6 must be able to be made on the entire length of the tongues 5.

SUMMARY OF THE INVENTION

An object of the invention is to propose a female electrical contact element that is able to receive and maintain in connection position a male contact element, roughly cylindrical, whatever the connection conditions and particularly in the presence of high temperatures, significant temperature variations, significant vibrations, etc. Another object of the invention is to propose such a female contact element that is manufactured simply and inexpensively, not necessitating complex assembly.

For this purpose, the invention proposes making a female terminal in two parts. A first part, or plastic connection part, ensures the connection between the female terminal and an electrical conductor such as a cable. A second part, or elastic active part, ensures contact pressure between the female terminal and an inserted male terminal, whatever the environmental conditions, for example during extreme vibrations and/or significant temperature variations. The plastic connection part is a one-piece body in which two cavities are arranged. The first cavity is designed to receive the cable, while the second cavity is designed to receive the elastic active part. Therefore, only the elastic active part is inserted. The second cavity, designed to receive the elastic active part, may be arranged roughly. The only area of the second cavity meant to be precise is the open end. Open end refers to the end by which the male terminal is introduced into the second cavity. In fact, the inner wall of the open end of the second cavity must come into contact with the lugs of the elastic active part when said lugs are moved apart by the presence of the male terminal. The area of contact between the lugs of the elastic active part and the inner wall of the second cavity must therefore be machined precisely. The area of contact must first allow entry of the male terminal into the elastic active part of the female terminal and, secondly, prohibit any clearance of said male terminal in the elastic active part. The plastic connection part and the elastic active part may be made of different conductive materials.

Therefore, the object of the invention is a female contact element comprising a rear shank designed to receive an electrical conductor and a front shank equipped with an elastic socket designed to receive a male contact element, characterized in that it is formed from a one-piece tubular body in which the front shank and the rear shank are arranged, the elastic socket being fixed mounted in the front shank.

According to the examples of embodiment of the invention, the female contact element may comprise part or all of the following additional features:

- The elastic socket is fixed by an attaching end to a transverse wall of the tubular body separating the front shank and the rear shank.
- The elastic socket is equipped with a plurality of longitudinal tongues.
- The tongues of the elastic socket can be braced in the direction of the inner wall of the front shank, during introduction of a male contact element in the front shank.
- An open end of the front shank is equipped with a centripetal flange able to form a mechanical stop for the tongues of the elastic socket.
- The attaching end of the elastic socket is screwed into a screwing opening arranged in the transverse wall of the tubular body.
- The attaching end of the elastic socket is fitted with a head in the screwing opening.

The invention also relates to a method of making a female contact element characterized in that the method comprises steps consisting of:

Machining a tube at its two extremities in such a way as to arrange a front shank and a rear shank in an inner volume of the tube;

Inserting and fixing the elastic socket in the front shank.

According to the examples of embodiment of the method of the invention, it is possible to add part or all of the following additional steps:

Machining the tube in such a way that a centripetal flange is arranged at the level of the end of the tube forming the open end of the front shank.

Fixing the elastic socket in the shank in such a way that a free end of the elastic tongues of the socket may abut against the centripetal flange.

Machining the front shank and the rear shank with a precision on the order of a tenth of a millimeter, and machining the open end of the shank, at the level of the centripetal flange, with a precision on the order of a hundredth of a millimeter.

Machining the front shank and the rear shank with a precision between 0.15 and 0.40 mm, plus or minus 0.05 mm and machining the open end of the shank, at the level of the centripetal flange with a precision between 0.015 and 0.035 mm, plus or minus 0.0005 mm.

Machining the tube in such a way as to arrange a transverse wall separating the front shank from the rear shank.

Arranging a screwing opening in the transverse wall of the tube.

Screwing the attaching end of the elastic socket into the screwing opening.

Fixing a head onto the attaching end of the elastic socket in the screwing opening.

BRIEF DESCRIPTION OF THE DRAWINGS

The invention will be better understood upon reading the following description and examining the accompanying figures. The latter are presented for indication purposes only and in no way limit the invention. The figures represent.

DETAILED DESCRIPTION OF THE INVENTION

Figure 1:
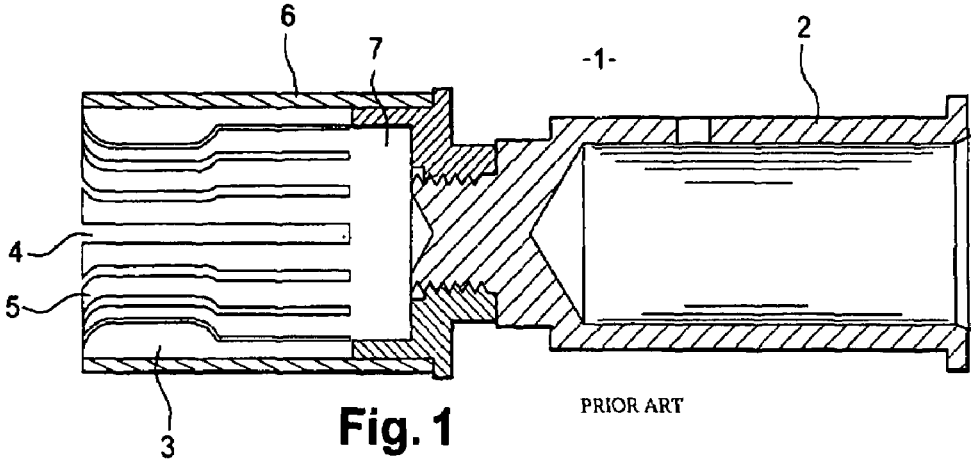
Fig. 1 PRIOR ART
FIG. 1 is a sectional view of a female contact element from the prior art already described.
Figure 2:
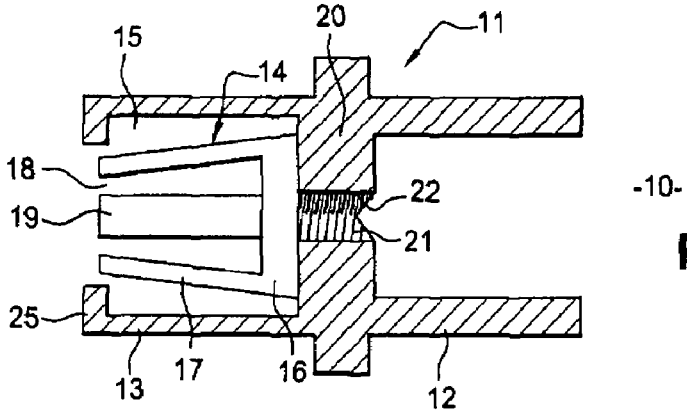
FIG. 2 is a sectional view of an embodiment of a female contact element according to the invention.

FIG. 2 represents a female contact element 10 according to an example of embodiment of the invention.

The female contact element 10 comprises two distinct parts. A first part 11 is equipped with a body in a generally cylindrical tube shape in which are arranged a rear shank 12 and a front shank 13. The rear shank 12 is, for example, designed to be crimped on an electric cable. The front shank 13 is designed to receive a complementary male contact element in a generally cylindrical shape (not represented in FIG. 2). For this purpose, an elastic socket 14, forming the second part of the contact element 10, is fixed mounted in a cavity 15 of the front shank 13. The rear shank 12 and the front shank 13 are separated from each other by a transverse wall 20, diametrically traversing the first part 11. The transverse wall 20 forms the bottom of the rear shank 12 and the front shank 13.

The elastic socket 14, housed in the front shank 13, comprises a base 16 from which a plurality of tongues 17 branch off. The tongues 17 extend from the base 16 in the direction of an open end 18 of the front shank 13. The open end 18 of the front shank 13 is opposed to the bottom of the front shank 13 formed by the transverse wall 20. The tongues 17 therefore have a free end 19, directed towards the open end 18 of the front shank 13, and a fixed end integral with the base 16. The tongues 17 are regularly distributed on the entire external perimeter of the roughly circular base 16. The free extremities 19 of the tongues 17 have a centripetal orientation, towards the center of the elastic socket 14, with relation to the fixed extremities, in such a way that a diameter of said socket 14 at the level of the base 16 is strictly greater than a diameter of the socket 14 at the level of free extremities 19 of the tongues 17. For example, the diameter of the socket 14 at the level of the free extremities 19 of the tongues 17 is strictly less than the diameter of the male contact element designed to be housed in the front shank 13, and more precisely in the elastic socket 14.

The circular base 16 of the socket 14 is equipped, on a face directed toward the transverse wall 20, with an attaching end 21. The attaching end 21 is equipped with a thread in order to be screwed into a screwing opening 22 arranged in the transverse wall 20 of the tubular body 11. The elastic socket 14 is screwed in the transverse wall 20 of the tubular body 11. Therefore, fixed maintenance of the socket 14 in the cavity 15 of the front shank 13 is guaranteed. In order to ensure the irreversible fixation of the socket 14 in the front shank 13, it is possible to fit the attaching end 21 with a head once the end is screwed into the screwing opening 22. Therefore the thread of the attaching end 21 of the socket 14 is broken, which makes it impossible to unscrew said socket 14. Of course, it is possible to connect the socket 14 by any other means in the cavity 15 of the front shank 13. For example, it is possible to glue, solder the base 16 on the transverse wall 20 of the tubular body 11.

The socket 14 may, for example, by made of beryllium copper in order to present elasticity and conductivity properties that allow it to receive the male contact element and to guarantee good electrical contact between the two elements. The tubular body 11 may, itself, be made of a conventional copper alloy.

It is important that the tongues 17 of the socket 14 have sufficient elasticity to allow passage of a male contact element 23 (FIG. 3), as well as its maintenance in position in the front shank 13.

Figure 3:
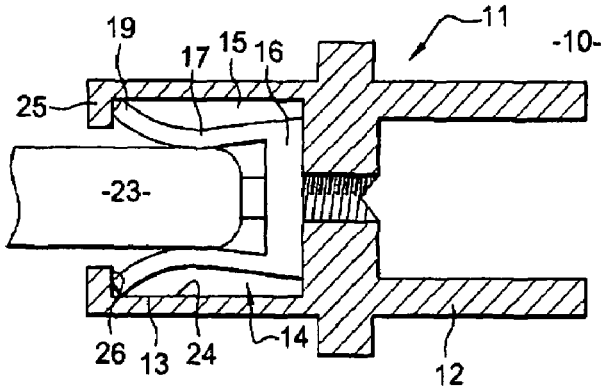
FIG. 3 is similar to FIG. 2, but depicting a male contact element received with the female contact element.

In FIG. 3 can be seen a male contact element 23 housed in the socket 14 of the female contact element 10 of the invention.

During the introduction of the male contact element 23 in the socket 14, the male contact element spreads the tongues 17 apart in the direction of an inner wall 24 of the front shank 13. The tongues 17 are braced in the direction of said inner wall 24.

The open end 18 of the front shank 13 is bordered by a centripetal flange, that is, directed towards a center of the cavity 15 of the front shank 13. The presence of the centripetal flange 25 narrows the diameter of the front shank 13 at the level of the open end 18, but, however, allows passage of the male contact element 23 in the front shank 13.

The centripetal flange 25 forms a mechanical stop 26 for the free end 19 of the tongues 17. More precisely, when the male contact element 23 is housed in the socket 14, the tongues 17 are braced in such a way that the free end 19 of said tongues 17 is stopped against 26 the centripetal flange 25. The tongues 17 are also blocked at their two extremities.

In the female contact element 10 according to the invention, only the area of abutment 26 must be machined in a very precise manner. In fact, the cavity 15 of the front shank 13 may be machined with a low precision, on the order of 0.15 to 0.40 mm, and more preferentially on the order of 0.2 to 0.3 mm, as with the cavity of the rear shank 12. On the other hand, the area of the front shank 13 forming the abutment 26 must be machined in a very precise manner, with a precision on the order of 0.015 to 0.035 mm, and more preferentially on the order of 0.02 mm. In fact, the area of abutment 26 must allow blocking of the free end 19 of the tongues 17 in a position ensuring electrical conduction and the maintenance of the contact element 23 without clearance in the front shank 13.

Therefore, it is possible to machine the tubular body 11 from a solid copper alloy tube, for example, in such a way as to arrange the front shank 13 and the rear shank 12. This machining step is relatively simple and may easily be performed automatically. The tubular body 11 is, for example, maintained in position by a clamp, while a tool hollows out a shank at each of its extremities. The two shanks 12, 13 obtained are separated from each other by a transverse wall 20 situated for example at the level of the central part of the tubular body 11. One may therefore arrange a screwing hole 22 in the transverse wall 20, designed to receive the attaching end 21 of the socket 14. The socket 14 may, for example, be molded or also machined.

After the first crude machining of the two shanks 13, 14 in the tubular body 11, the area of abutment 26 is machined very precisely so that it is specifically adapted to the socket 14 and to the male contact element 23 that are designed to be housed in the front shank 13. Specifically adapted means that the machining of the area of abutment 26 depends on the length of the tongues 17 and their radius of curvature when the male contact element 23 is introduced, and therefore also on the diameter and the length of penetration of the male contact element 23 in the socket 14.

Once machining of the tubular body 11 has ended, the socket 14 is fixed in the front shank 13 in such a way as to obtain the female contact element 10 of the invention.

The number of steps necessary for constructing such a female contact element 10 according to the invention is therefore low, which allows the risks of poor mounting or poor machining of the female contact element 10 to be reduced.

The invention claimed is:

1. A female contact element formed from a one-piece machined tubular body comprising:

a rear shank having a cavity designed to receive an electrical conductor; and a front shank having a cavity equipped with an elastic socket having a plurality of longitudinal tongues, the elastic socket adapted to receive a male contact element, wherein an open end of the front shank is equipped with a centripetal flange adapted to form a mechanical stop for free extremities of the longitudinal tongues of the elastic socket only when the male contact element is positioned within the front shank, and wherein a precision of machining of the tubular body is on an order of a tenth of a millimeter, and a precision of machining of the front shank is on an order of a hundredth of a millimeter, wherein the elastic socket is fixed by an attaching end to a threaded through opening in a transverse wall of the tubular body separating the front shank from the rear shank.

2. The female contact element according to claim 1, wherein the precision of machining of the tubular body is in a range from about 0.15 millimeter to about 0.40 millimeter, and the precision of the machining of the front shank at a location of the centripetal flange is in a range from about 0.015 millimeter to about 0.035 millimeter.

3. The female contact element according to claim 2, wherein the longitudinal tongues of the elastic socket are adapted to be braced in the direction of the inner wall of the front shank, during introduction of the male contact element in the front shank.

4. The female contact element according to claim 1, wherein the attaching end of the elastic socket is screwed into a threaded opening positioned in the transverse wall of the tubular body.

5. The female contact element according to claim 4, wherein the attaching end of the elastic socket is fitted with a head in the threaded opening.

6. The method of making a female contact element comprising:

machining a one piece tube body at a first end and a generally opposing second end in such a way as to position a front shank and a rear shank in an inner volume of the tube with a precision on an order of a tenth of a millimeter each of the front shank and the rear shank having a cavity;

machining a centripetal flange at the first end of the tube forming an open end of the front shank, with a precision on an order of a tenth of a millimeter;

inserting and fixing an elastic socket in the front shank in such a way that free extremities of longitudinal tongues of the elastic socket abut the centripetal flange upon introduction of a male contact element into the front shank, machining the tube such that a transverse wall separates the front shank from the rear shank;

arranging a threaded through opening in the transverse wall of the tube; and screwing the attaching end of the elastic socket in the threaded through opening.

7. The method according to claim 6, further comprising:

fitting a head to the attaching end of the elastic socket in the threaded opening.

8. The method according to claim 6, further comprising:

machining the front shank and the rear shank with a precision between about 0.15 millimeter and about 0.40 millimeter;

machining the open end of the front shank at the centripetal flange with a precision between about 0.015 millimeter and about 0.035 millimeter.

* * * * *

UNITED STATES PATENT AND TRADEMARK OFFICE

CERTIFICATE OF CORRECTION

PATENT NO. : 7,393,252 B2
APPLICATION NO. : 11/492743
DATED : July 1, 2008
INVENTOR(S) : Ribeau et al.

It is certified that error appears in the above-identified patent and that said Letters Patent is hereby corrected as shown below:

Title page Field (73):
Delete "Sourian" and insert --Souriau--.

Column 4, Line 35:
Delete "by" and insert --be--.

Column 4, Line 63:
After "26" insert --of--.

Signed and Sealed this

First Day of September, 2009

David J. Kappos

David J. Kappos
*Director of the United States Patent and Trademark Office*